United States Patent [19]

Zukauskas

[11] 3,950,951

[45] Apr. 20, 1976

[54] COVERED GUTTER

[76] Inventor: Raymond Zukauskas, 99 Chippewa Road, Yonkers, N.Y. 10710

[22] Filed: July 8, 1974

[21] Appl. No.: 486,473

[52] U.S. Cl. ..... 61/15; 52/12

[51] Int. Cl.[2] ..... E02B 9/04; E04D 13/00

[58] Field of Search ..... 61/14, 15; 52/11, 12, 52/15; 248/48.1; 210/477, 474

[56] References Cited

UNITED STATES PATENTS

| | | | |
|---|---|---|---|
| 116,072 | 6/1871 | Lockwood | 52/15 |
| 836,012 | 11/1906 | Cassen | 52/12 |
| 1,313,742 | 8/1919 | Schad | 52/12 |
| 2,120,395 | 6/1938 | Dean | 52/12 X |
| 2,583,422 | 1/1952 | Haddon | 52/12 X |
| 2,672,832 | 3/1954 | Goetz | 52/12 |
| 3,388,555 | 6/1968 | Foster | 61/15 |
| 3,436,878 | 4/1969 | Singer | 52/12 |
| 3,550,381 | 12/1970 | South | 61/15 |

*Primary Examiner*—Dennis L. Taylor
*Attorney, Agent, or Firm*—Smythe & Moore

[57] ABSTRACT

A one-piece rain gutter having a horizontally inclined upper surface with corrugations and a vertically inclined depending portion joined to the horizontal portion with a relatively sharp bend, there also being a bottom piece and vertical portion with the vertical portion spaced from the vertically inclined depending portion to receive water therebetween.

7 Claims, 9 Drawing Figures

FIG. 5
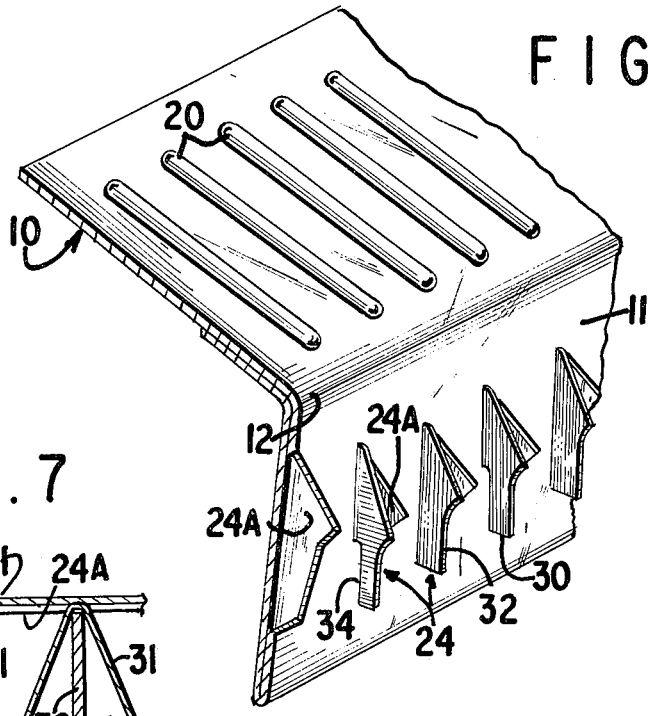
FIG. 7
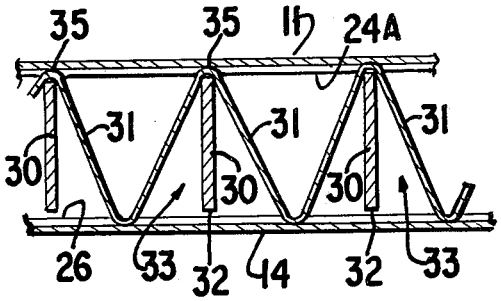
FIG. 6
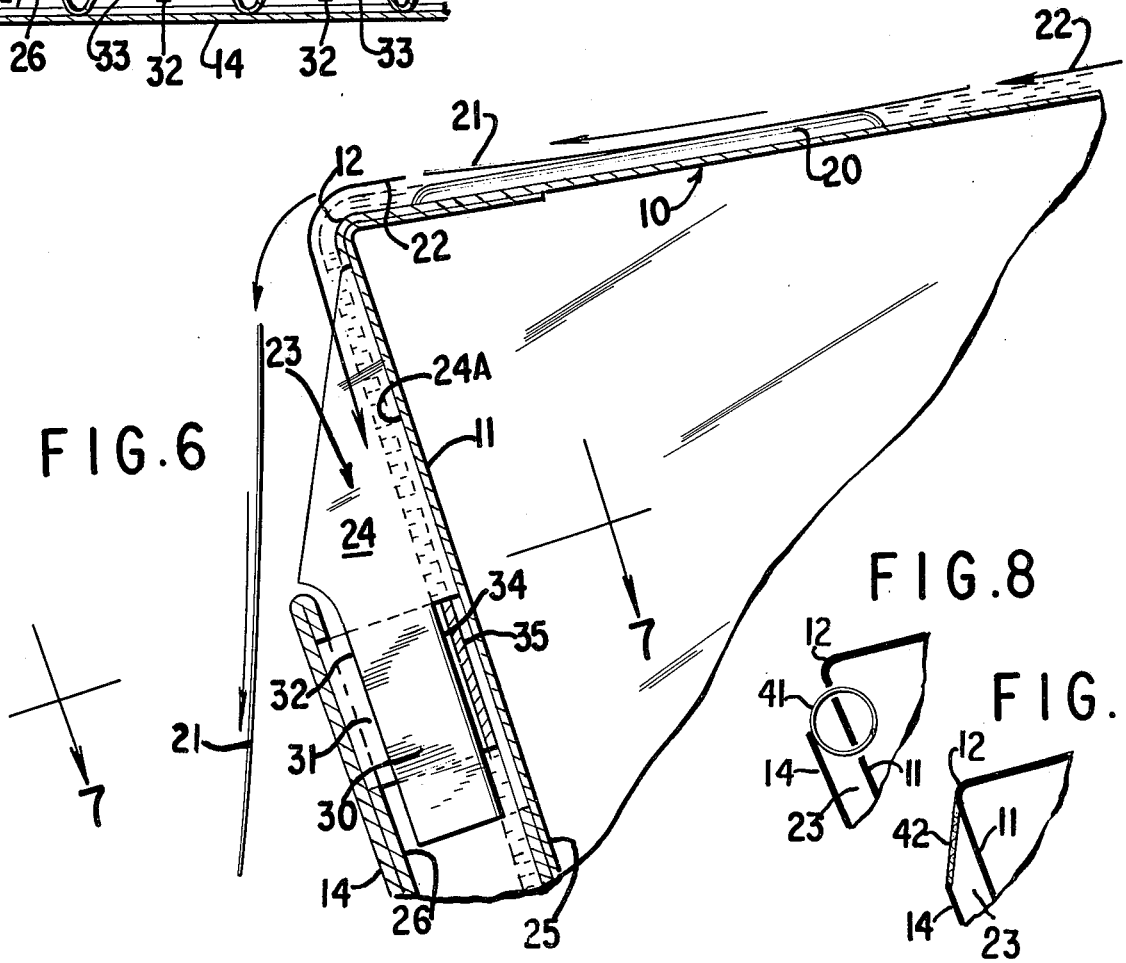
FIG. 8
FIG. 9

COVERED GUTTER

The invention relates to a rain gutter of the type employed to catch rain water from the edges of roofs.

It is desirable in rain gutters to provide an inexpensive, efficient gutter that will not become clogged by leaves and other debris. The clogging of prior open type gutters often requires possibly dangerous maintenance problems. While over the years there have been many attempts to solve this problem, there has not been, for various reasons, an integrated single satisfactory solution.

Prior gutters have inherent flaws which precluded proper functioning. Basically, the prior assumption was that in order to facilitate the flow of water from the upper inclined surface to the lower inclined surface, the two surfaces had to be connected by a curved or rounded portion or "nose." This type of design prevented larger, heavier objects from entering into the gutter. However, lighter, more flexible objects, such as leaves, paper etc., which have a large surface area and have a low relative density, were held by the surface tension of the water as it flowed past the curved portion and were thus carried into the inside of the gutter, see Cassens U.S. Pat. No. 891,405. An attempt to correct this defect can be seen in Bartholemew U.S. Pat. No. 2,669,950. However, the structures thereof also presumed the necessity of the curved portion of the surface and attempted to correct such by introducing a row or rows of pyramidal or V-shaped protrusions about one inch downstream from the nose in order to strip the leaves from the cover surface before they reached the inside of the gutter.

One of the objects of the invention is to provide an inexpensive rain gutter that will not become clogged by material coming off the roof.

Another of the objects of the invention is to provide an improved gutter construction and method of forming the same.

In accordance with the present invention, it has been found that if a liquid is allowed to flow on an inclined plane that abruptly changes in a downward direction even if it swings past the vertical position, that the liquid will tend to flow along the lower inclined plane unless (a) a critical quantity of the liquid (b) a critical velocity of the liquid and (c) a critical angle of the rotation between the upper horizontal and lower vertical inclined planes are exceeded. In dealing with the collection of rainwater from roof surfaces, neither the quantities nor the velocity of the water normally approach the critical limits so that by locating the lower inclined plane within the critical angle limits, the foregoing described flow will occur. Since solid objects do not possess these physical characteristics of of liquids, the inherent physical behavioral difference between solids and liquids is used. In one aspect of the invention, a gutter can be made with a solid top surface which is slightly inclined and then is bent abruptly downward past the vertical, the lower inclined portion of the gutter being utilized to direct water or liquids almost immediately into the inside of the gutter. The mouth of the gutter is a narrow horizontal slot in the front face of the gutter located at a desirable point below the edge which is the junction of the lower and the upper inclined planes of the top of the gutter. The opening is the narrow space left between two ends of one piece of sheet metal, plastic or other suitable material.

The horizontal inclined or cover surface can have corrugations therein and the downwardly extending surface can have projections formed from or located thereon.

The gutter can be made or formed in various manners such as by suitably bending a flat piece of material to the desired shape. The various portions also can be formed separately and then joined in any suitable manner. Further, the front inclined surfaces can be interlocked.

Other features, objects and advantages will become apparent from the following description and drawings which are merely exemplary.

In the drawings:

FIG. 5 is an enlarged fragmentary view of the horizontal inclined portion and adjoining vertical inclined portion;

FIG. 6 is an enlarged fragmentary sectional view showing the manner in which debris is separated;

FIG. 7 is a fragmentary enlarged section shown along the line 7—7 of FIG. 6; and FIGS. 8 and 9 are fragmentary sectional views of alternate types of leaf deflectors.

One form of the invention will now be described, it being understood that the same reference numerals will be used where appropriate to designate the same or similar parts in the various figures.

FIG. 1 illustrates a plurality of sections of gutters made in accordance with the invention such as seen in FIGS. 2, 5 and 6.

Figure 1:
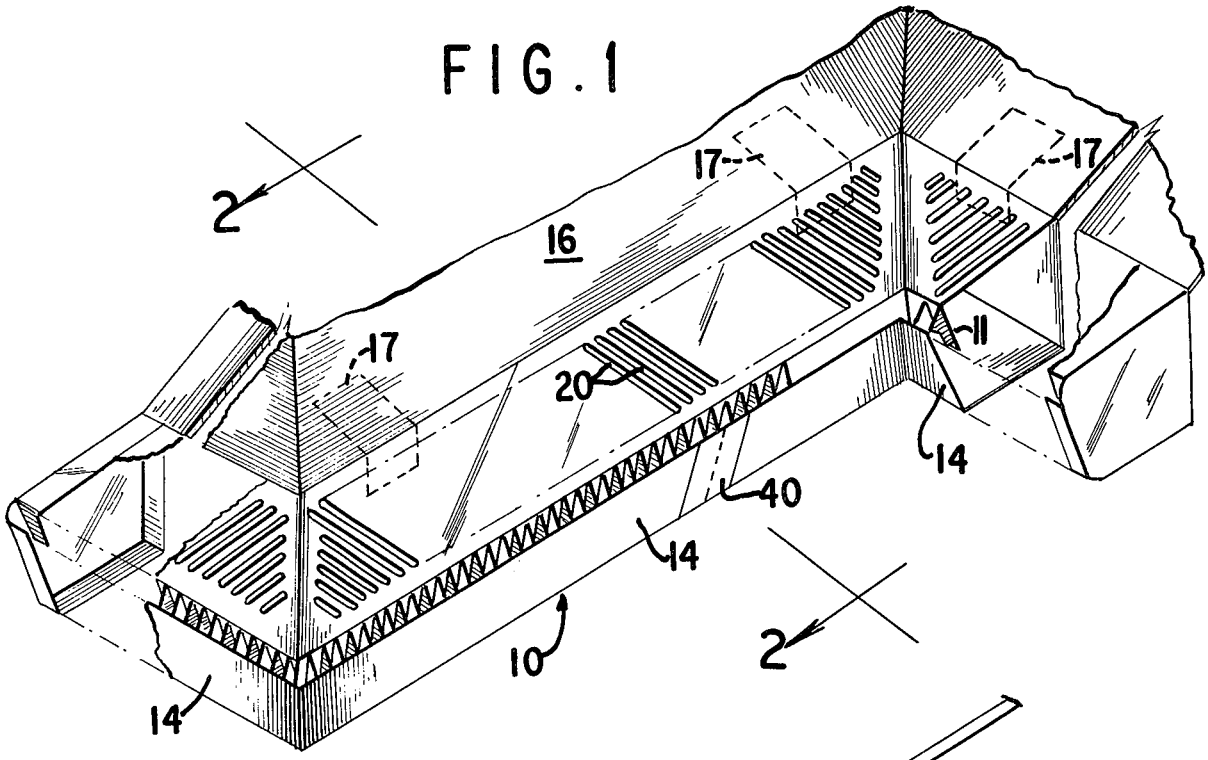
FIG. 1 is a broken perspective view of several joined sections of the gutter of the present invention.
Figure 2:
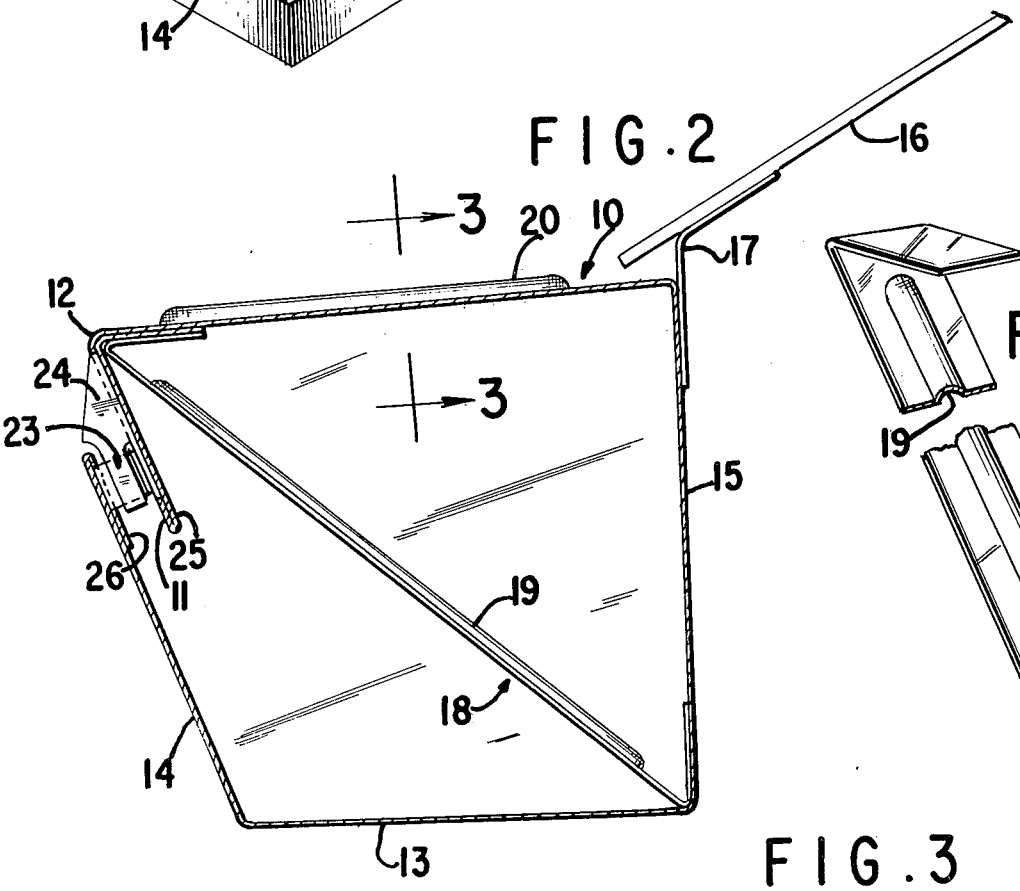
FIG. 2 is an enlarged sectional view taken along the line 2—2 of FIG. 1 but with an additional alternative strengthening piece embedded.
Figure 4:
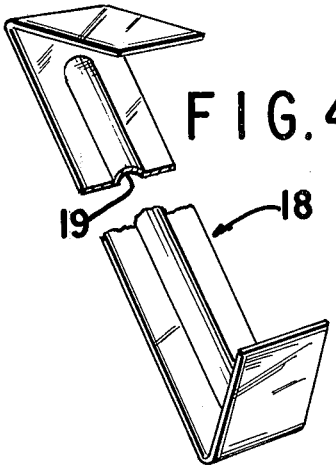
FIG. 4 is a broken perspective view of one of the strengthening members as seen in FIG. 2.
Figure 3:
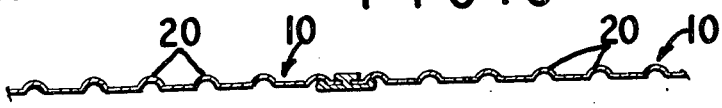
FIG. 3 is a fragmentary sectional view taken along the line 3—3 of FIG. 2.

Referring now to FIG. 2, horizontally downwardly inclined cover portion or panel 10 has joined thereto vertically inclined front portion or panel 11, portions 10 and 11 being joined by the distinct or abrupt surface or nose 12. Bottom 13 is joined to front portion 14 and rear portion 15. Portion or panels 10, 11, 13, 14 and 15 can be bent from a flat sheet of metal or suitable material in various manners such as a conventional metal brake or by forming dies. The gutter can be suspended or fastened to roof 16 by brackets 17 fastened to back panel or portion 15.

If needed or desired, a reinforcing member 18 can be placed inside the gutter reinforcing members or bracket 18 having a rib 19 formed. Corrugations 20 can be formed in the upper portion 10.

Since the only way in which a leaf can be carried into the gutter with the configuration illustrated is by surface tension of the water, the top surface area of the inclined surface 10 to which a leaf might cling, has been reduced by introducing a row of corrugations 20. Such corrugations deny the leaf a large flat area of the top surface 10 by allowing it to bear on only the tops of currugations 20 and allowing the rain water to flow under the leaf.

FIG. 6 illustrates the manner in which a leaf 21 rides on corrugations 20, water being illustrated by arrows 22 running thereunder. The water will follow bend 12 and enter opening 23.

The corrugations 20 also will tend to strengthen and stiffen top portion 10, will direct the flow of water down rather than laterally, will distribute the flow of water more evenly, and reduce the splashing of water coming off the roof.

When a leaf is washed down by the water and it approaches edge 12, the surface tension of the water has a tendency to bend the leaf over and thus continue to cause the leaf to adhere to the lower inclined surface 11.

To negate this effect, immediately past the edge 12 a series of substantially vertical fins or leaf deflectors 24 have been formed. The vertical fins will minimize the area of lower inclined surface 11 to which the leaves can adhere. As a leaf turns over edge 12 (FIG. 6) it is kept away from surface 11 by the vertical fins or leaf deflectors 24 which offer only the front edge to which the leaf might adhere. In this manner, as a leaf turns over edge 12 with no appreciable area to cling to on its lower portion, the water flowing under it will wash the leaf thereover. Thus, this configuration creates a situation where the rain water is utilized to remove the debris from the top surface so that the gutter becomes, in effect, self cleaning.

Vertical leaf deflectors 24 may be made in a number of different ways and still perform equally well.

Inasmuch as it is more economical to make this type of gutter from a single piece of sheet metal or other suitable material such as plastic, the fins are shown as punched out sections and rotated forward 90° or other desired angle to stand in front of lower inclined front surface 11. In this manner, the vertical fins will serve another function which is to interlock with the front surface 14 of the gutter in a manner which insures a uniform and constant width of slot 23 which serves as the mouth or entrance to the gutter.

Merely by way of example, the gutter can be made of aluminum having a thickness of 0.027 inch or 0.032 inch. In such a case, the abrupt nose or bend can be in the range of 1/16 inch to ¼inch diameter respectively.

The material of portion 11 is then shown as doubled back on itself, such as at 25, inside the gutter along the inside surface of 11, and partially as a result, a double function is accomplished because it closes the openings in surface portion 11 left by the punched out areas 24A in forming leaf deflectors 24, and it reinforces the edge 12 against possible damage such as when a ladder, for example, is placed against it.

The lower portions 30 of leaf deflectors 24 may be interlocked with the front portion 14. One manner of so doing is illustrated in FIGS. 6 and 7. The front panel 14 is doubled back on itself as seen at 26 and a portion 31 thereof shaped, for example, by expanding the metal to form an undulated portion. The deflectors 24 are dimensioned so that the front edge 32 thereof can be inserted into openings 33. The rear edges 34 of alternate deflectors 24 are cut so that the expanded edge 35 will be held in place. Thus, the front panel 14 is locked into place.

Once the lower protrusions 30 of the leaf deflectors 24 are snapped into the openings 33, the total front surface of the gutter, comprised of the lower inclined surface 11 and the front surface portion 14, becomes ridgidly joined to act more or less as a single surface.

The leaf deflectors 24 are thereby held rigidly in their intended position. They act as spacers to insure the constancy of the slot or mouth into the inside of the gutter (FIG. 5) and the total gutter section approaches the structural characteristics of a similarly shaped, entirely closed section. Such a configuration is advantageous in that it becomes a self-supporting section not unlike that of a tube section which simplifies its attachment in its intended location and because of this inherent structural strength, the thickness of the material from which this section is made can be reduced with corresponding savings in its manufacture.

To attach this gutter in the required location, a continuous strip or spaced strips of suitable material can be attached to the back surface 15 or to the top surface 10. The thickness and the number of fasteners will be determined by structural requirements. Such strips of material can be bent to conform to the existing field conditions and fastened as required.

The preferred embodiments of this type of gutter section previously described is ideally suited to be manufactured from a single piece of sheet metal. However, it can be made from a number of pieces of sheet metal or other suitable material, such as various plastics, and still be within the scope of this invention. Only some details would have to be modified to take advantage of such differences in manufacturing techniques such as injection molded plastics or other suitable methods.

This type of gutter section can also be made in two pieces, one comprised of the top inclined surface (10) and the lower inclined surface (11) and the leaf deflectors (24) described. The two pieces could then be joined at the intersection of the top inclined section and the back of the gutter by means of a hinge, a snap-on or other suitable mechanisms (not shown). In this manner, such would facilitate the opening of this section for cleaning or other purposes. Also, a device comprised of the elements, and as previously described, can be made with appropriate modifications and appropriate fastening devices to serve as a shield or cover over a variety of existing open gutters.

The typical gutter sections can be joined by butting them together and enclosing this joint with cover straps 40 together with appropriate fasteners and caulking. The top inclined surfaces are joined by snapping on closure pieces manufactured from plastic or other suitable material and which are designed to prevent debris from becoming lodged in the top joint.

The leaf deflectors also could be replaced by a helical coil 41 (FIG. 8) or screen 42 (FIG. 9) made of metal or plastic, the coil or screen being placed in position between edge 12 and on the edge of opening 23.

The prefabricated outside and inside corner pieces and end caps are made slightly larger so as to allow the typical sections to be slipped into them.

The maintenance of the gutter of the present invention is substantially reduced and simplified. In case leaves or other debris should become lodged between the leaf deflectors, such obstructions would be visible from the ground. The cleaning of such obstructions can also be accomplished from the ground eliminating the possible hazard of climbing on a ladder which is presently associated with such tasks.

It should be apparent that modification can be made in details of construction without departing from the spirit of the invention except as defined in the appended claims.

What is claimed is:

1. In a gutter, the combination including a downwardly inclined top surface means for receiving water thereon, a first inclined front surface means joined to said top surface means with an abrupt longitudinally extending edge therebetween, a second front surface means spaced from said first inclined front surface means and in front thereof, a plurality of closely spaced vertical deflectors in the space between said first and second front surface means for deflecting solids away from said space and to the outside of said second front surface, so that water will be directed from said top surface means to the space between said first and second front surface means into the interior of said gutter, said abrupt edge assisting in separating any solids being carried by the water so that the solids pass outside of said second front surface.

2. A gutter as claimed in claim 1 wherein said deflectors are formed from said first front surface means.

3. A gutter as claimed in claim 2 wherein said second front surface means has undulated strap means that can be interlocked with said deflectors.

4. A gutter as claimed in claim 3 wherein there are diagonal brace means on the inside of said gutter between said first front surface means and another wall of said gutter.

5. A gutter as claimed in claim 3 wherein said straps are formed from a doubled back portion of said second front surface.

6. A gutter as claimed in claim 1 wherein the first inclined front surface means and the second front surface means are doubled back on themselves so as to strengthen said edge and the top edge of the second front surface means.

7. In a gutter, the combination including a downwardly inclined top surface means for receiving water thereon, said top surface means being solid and having raised portions thereon for carrying solids thereon and on said raised portions allowing water to pass under said solids, a first inclined front surface means joined to said top surface means with an abrupt longitudinally extending edge therebetween, and a second front surface means spaced from said first inclined front surface means and in front thereof, a plurality of closely spaced vertical deflectors in the space between said first and second front surface means for deflecting solids away from said space and to the outside of said second front surface, so that water will be directed from said top surface means to the space between said first and second front surface means into the interior of said gutter, said abrupt edge assisting in separating any solids being carried by the water so that the solids pass outside of said second front surface.

* * * * *